US007086617B2

(12) United States Patent
Fukumoto et al.

(10) Patent No.: US 7,086,617 B2
(45) Date of Patent: Aug. 8, 2006

(54) LIQUID SPRAYER

(75) Inventors: Hiroshi Fukumoto, Tokyo (JP); Jyunichi Aizawa, Tokyo (JP); Munehisa Takeda, Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 1056 days.

(21) Appl. No.: 09/750,664

(22) Filed: Jan. 2, 2001

(65) Prior Publication Data

US 2002/0011533 A1 Jan. 31, 2002

(30) Foreign Application Priority Data

Jul. 25, 2000 (JP) ..... P2000-223915

(51) Int. Cl.
*F32D 11/32* (2006.01)

(52) U.S. Cl. ..... 239/690; 239/708; 239/601; 239/696

(58) Field of Classification Search ..... 239/690, 239/690.1, 696, 708, 601
See application file for complete search history.

(56) References Cited

U.S. PATENT DOCUMENTS 4,046,074 A * 9/1977 Hochberg et al. ..... 346/25
6,182,907 B1 2/2001 Nakagawa et al.

FOREIGN PATENT DOCUMENTS

| | | |
|---|---|---|
| JP | 62-85948 | 4/1987 |
| JP | 4-294150 | 10/1992 |
| JP | 9-226145 | 9/1997 |
| JP | 2000-43243 | 2/2000 |

OTHER PUBLICATIONS

Hiroshi Fukumoto, et al. "Printing with Ink Mist Ejected by Ultrasonic Waves", IS & Ts NIP15: 1999 International Conference on Digital Printing Technologies, 1999, pp. 310-314.

* cited by examiner

*Primary Examiner*—Christopher Kim
(74) *Attorney, Agent, or Firm*—Oblon, Spivak, McClelland, Maier & Neustadt, P.C.

(57) ABSTRACT

A nozzle hole of a conductive nozzle plate exposes the liquid surface of conductive ink. Ultrasonic generation means vibrates the ink for forming fine surface waves on the liquid surface so that the ink is sprayed from the nozzle hole as an atomized liquid particle group. A back plate provided on the opposite side of the nozzle hole in relation to a printing paper is supplied with a potential different from that for the nozzle plate, so that an electric field is formed therebetween. The sprayed liquid particle group is charged and hence urged by this electric field to adhere to the printing paper.

13 Claims, 9 Drawing Sheets

LIQUID SPRAYER

BACKGROUND OF THE INVENTION

1. Field of the Invention

The present invention relates to a liquid sprayer for spraying a liquid on an object.

2. Description of the Background Art

In general, a liquid sprayer for spraying a liquid on an object includes an inkjet head of a printer, for example. The inkjet head sprays ink forming a liquid on a printing paper forming an object so that the former adheres to the latter. A desired pattern can be printed on the printing paper by controlling the spray timing and the relative positional relation between the inkjet head and the printing paper.

In order to improve the resolution of the printed desired pattern, it is preferable to finely control the quantity of the sprayed ink. As refined, however, the sprayed ink tends to float before reaching the printing paper with a high possibility of adhering to undesired portions. Therefore, the inkjet head must precisely control the range of the ink adhering to the printing paper.

SUMMARY OF THE INVENTION

According to a first aspect of the present invention, a liquid sprayer comprises: a liquid holder exposing a liquid surface of conductive liquid sprayed on an object; and a field applier forming an equipotential surface convexed with respect to the liquid surface.

The liquid sprayer according to the first aspect can obtain field distribution converged as separating from the liquid surface, thereby spraying the liquid while converging the same on the object. Thus, the range of the liquid adhering to the object can be precisely controlled.

According to a second aspect of the present invention, the liquid sprayer comprises a conductive nozzle plate, supplied with a potential different from that for the object, having a first opening exposing the liquid surface and a second opening wider than the first opening and arranged closer to the object than the first opening.

In the liquid sprayer according to the second aspect, the nozzle plate is conductive, whereby the first and second openings are at the same potential. The second opening is wider than the first opening and closer to the object than the first opening, whereby the equipotential surface in the vicinity of the liquid surface of the liquid is convexed with respect to the liquid surface.

According to a third aspect of the present invention, the liquid sprayer further comprises a concave portion provided between the first opening and the second opening and concaved with respect to the object.

According to a fourth aspect of the present invention, the angle in the first opening of the nozzle plate is in excess of 270°.

According to a fifth aspect of the present invention, the first and second openings are provided in plural respectively.

According to a sixth aspect of the present invention, the liquid sprayer further comprises a vibration exitor provided in correspondence to each of the first openings and vibrating the liquid for spraying the liquid.

According to a seventh aspect of the present invention, the liquid sprayer further comprises a step provided between the first opening and the second opening.

According to an eighth aspect of the present invention, the first and second openings are provided in plural respectively.

According to a ninth aspect of the present invention, the shapes of the first and second openings are not similar to each other.

According to a tenth aspect of the present invention, the liquid sprayer comprises a conductive nozzle plate having a first opening exposing the liquid surface and a conductive auxiliary plate arranged closer to the object than the nozzle plate for exposing the first opening to the object.

In the liquid sprayer according to the tenth aspect, the nozzle plate and the auxiliary plate may not necessarily be supplied with the same potential but an equipotential surface convexed with respect to the liquid surface of the liquid can be formed by supplying these elements with a potential different from that for the object. Further, the first and second openings are separately provided on the nozzle plate and the auxiliary plate respectively, whereby the liquid can be readily wiped out on the first opening.

According to an eleventh aspect of the present invention, the nozzle plate and the auxiliary plate are supplied with the same potential.

A liquid sprayer according to a twelfth aspect of the present invention comprises a nozzle plate having an opening exposing a liquid surface of a liquid sprayed on an object and a discharger, supplying charges to the liquid at least on the liquid surface and a surface of the nozzle plate closer to the liquid surface, relatively movable with respect to the nozzle plate.

The liquid sprayer according to the twelfth aspect can control the potential of the liquid at least on the liquid surface and that of the nozzle plate on the surface closer to the liquid surface with the discharger in a non-contact manner. Therefore, it is possible to supply a potential different from that of the object to the nozzle plate without connecting a wire. The discharger and the nozzle plate are relatively movable and hence the object can be arranged on a position opposed to the liquid surface so that the liquid sprayed from the liquid surface can adhere to the object. Further, the liquid sprayer can employ an insulating nozzle plate or liquid.

According to a thirteenth aspect of the present invention, the discharger is a corona discharger.

According to a fourteenth aspect of the present invention, the liquid sprayer forms an equipotential surface convexed with respect to the liquid surface.

The liquid sprayer according to the fourteenth aspect can obtain field distribution converged as separating from the liquid surface, thereby spraying the liquid while converging the same on the object. Thus, the range of the liquid adhering to the object can be precisely controlled.

According to a fifteenth aspect of the present invention, the nozzle plate has a first opening exposing the liquid surface and a second opening wider than the first opening and arranged closer to the object than the first opening, and the discharger supplies the charges to the nozzle plate from the side of the second opening.

In the liquid sprayer according to the fifteenth aspect, the discharger supplies the charges to the nozzle plate from the side of the second opening wider than the first opening, thereby supplying the charges to both of the first and second openings. The second opening is wider than the first opening and present closer to the object than the first opening, whereby the equipotential surface in the vicinity of the liquid is convexed with respect to the liquid surface.

According to a sixteenth aspect of the present invention, the liquid sprayer further comprises a concave portion provided between the first opening and the second opening and concaved with respect to the object.

According to a seventeenth aspect of the present invention, the liquid is supplied with ultrasonic vibration and sprayed from the liquid surface.

According to an eighteenth aspect of the present invention, the liquid sprayer further comprises drive means generating the ultrasonic vibration and a reflecting wall reflecting the ultrasonic vibration propagating through the liquid and converging the ultrasonic vibration on the liquid surface.

According to a nineteenth aspect of the present invention, the liquid is supplied with ultrasonic vibration and sprayed from the liquid surface.

According to a twentieth aspect of the present invention, the liquid sprayer further comprises drive means generating the ultrasonic vibration and a reflecting wall reflecting the ultrasonic vibration propagating through the liquid and converging the ultrasonic vibration on the liquid surface.

In the liquid sprayer according to the seventeenth and nineteenth aspects, ultrasonic vibration is supplied to the liquid for atomizing droplets from the liquid surface, whereby the quantity of the liquid adhering to the object can be precisely controlled. Further, the range of the atomized droplets adhering to the object can be precisely controlled.

The liquid sprayer according to the eighteenth and twentieth aspects can increase sound energy on the liquid surface thereby improving the efficiency for spraying the liquid.

An object of the present invention is to provide a technique of urging a sprayed liquid toward an object thereby reducing floating of the liquid or further converging the liquid.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

Embodiment 1

Figure 1:
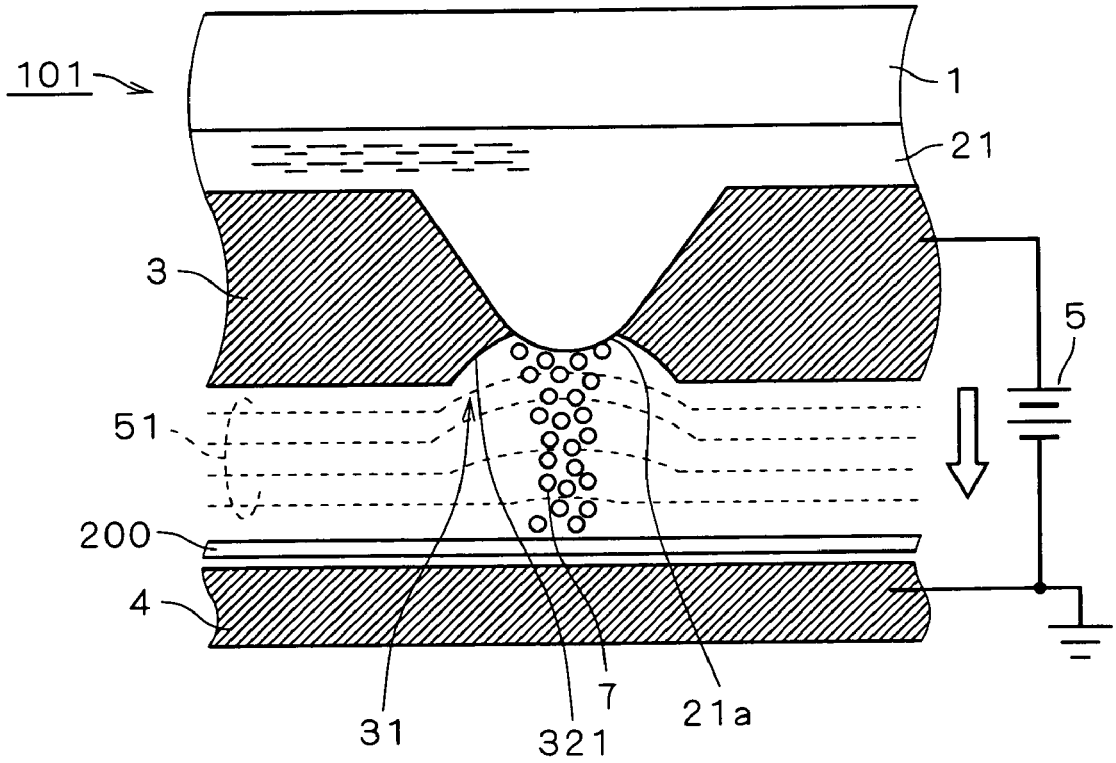
FIGS. 1 to 3 are sectional views typically showing the structure of an embodiment 1 of the present invention.

FIG. 1 is a sectional view typically showing the structure of an inkjet head 101 forming a liquid sprayer according to an embodiment 1 of the present invention and the relation between the same and a printing paper 200 forming an object.

The inkjet head 101 comprises ultrasonic generation means 1 generating thickness longitudinal vibration, for example, and a conductive nozzle plate 3 and stores conductive ink 21 therebetween. The nozzle plate 3 has a nozzle hole 31 exposing the liquid surface 21*a* of the ink 21, i.e., the nozzle plate 3 holds the liquid surface 21*a*. The ultrasonic generation means 1 vibrates the ink 21 for forming fine surface waves on the exposed liquid surface 21*a* thereby spraying the ink 21 from the nozzle hole 31 as an atomized liquid particle group 7.

Thus, whether or not to spray the ink 21 from the inkjet head 101 can be controlled in response to whether or not to generate vibration in the ultrasonic generation means 1. The printing paper 200 is arranged in opposition to the nozzle hole 31 so that these are relatively movable at need, whereby a desired pattern can be printed on the printing paper 200 by controlling the relative movement and generation of vibration in the ultrasonic generation means 1.

On the opposite side of the nozzle hole 31 in relation to the printing paper 200, a back plate 4 is provided at least in the vicinity of a position opposed to the nozzle hole 31. For example, the arrangement relation between the inkjet head 101 and the back plate 4 may be fixed so that the printing paper 200 relatively moves therebetween.

A dc voltage source 5 supplies different potentials to the nozzle plate 3 and the back plate 4. Referring to FIG. 1, the dc voltage source 5 supplies a positive potential and a ground potential to the nozzle plate 3 and the back plate 4 respectively. Thus, a potential gradient (electric field) is applied by the dc voltage source 5 between the nozzle plate 3 and the printing paper 200, as shown by an equipotential surface group 51 (appearing as equipotential lines in FIG. 1). The nozzle plate 3 is a conductor and the ink 21 is also conductive, and hence the sprayed liquid particle group 7 is charged. The electric field formed between the nozzle plate 3 and the back plate 4 urges and accelerates the charged liquid particle group 7 to adhere to the printing paper 200. As compared with the case of merely vibrating the ink 21 with the ultrasonic generation means 1 and spraying the same from the nozzle hole 31, therefore, the ink 21 can adhere to the printing paper 200 in a state prevented from floating. Referring to FIG. 1, white arrow roughly shows the direction of progress of the liquid particle group 7.

Figure 2:
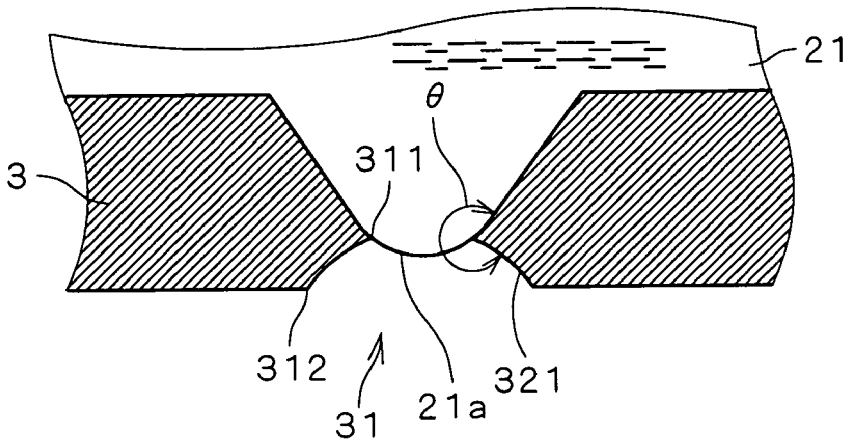

FIG. 2 is a sectional view showing a portion around the nozzle hole 31 in an enlarged manner. The nozzle hole 31 presents a concave portion 321 spreading toward the back plate 4, i.e., toward the printing paper 200. More specifically, the nozzle hole 31 has a first opening 311 exposing the liquid surface 21*a* of the ink 21 and a second opening 312 wider than the first opening 311 and located closer to the printing paper 200 than the first opening 311.

Figure 3:
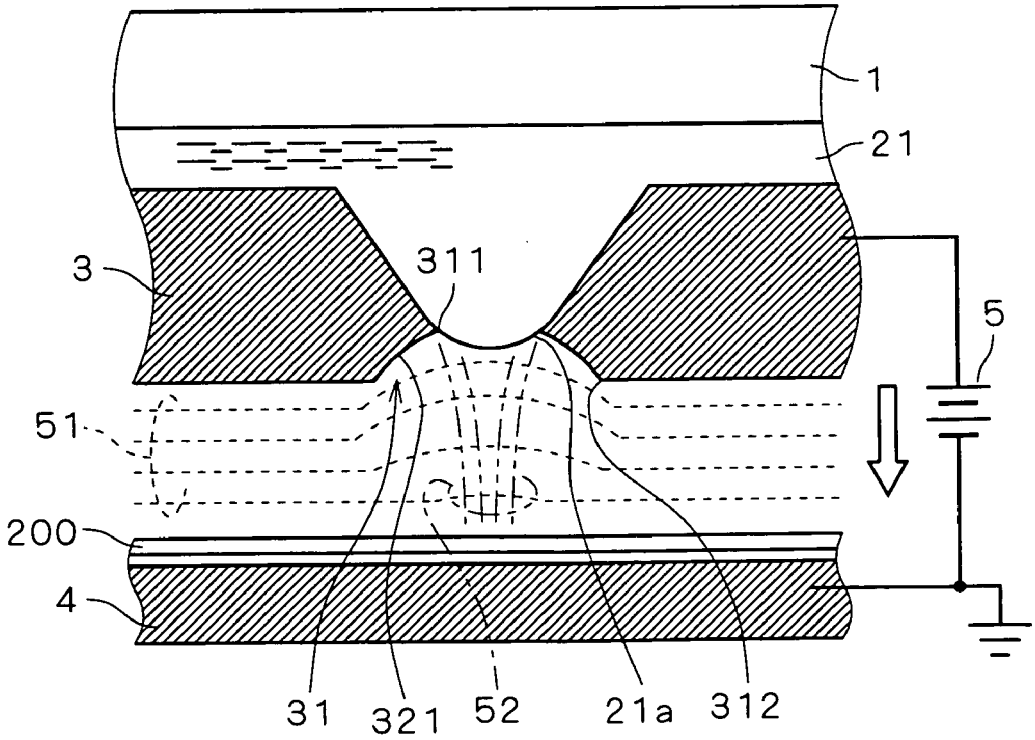

FIG. 3 is a sectional view typically showing the dc voltage source 5 connected between the nozzle plate 3 and the back plate 4 when not spraying the liquid particle group 7. The first and second openings 311 and 312 are at the same potential due to the conductivity of the nozzle plate 3. The second opening 312 is wider than the first opening 311 and present closer to the printing paper 200 than the first opening 311, whereby the equipotential surface group 51 in the vicinity of the liquid surface 21*a* of the ink 21 is convexed with respect to the liquid surface 21*a*.

An electric flux line group 52 showing electric flux lines in the vicinity of the first opening 311 indicates that field distribution converged as separating from the liquid surface 21*a* is obtained. Therefore, the inkjet head 101 can spray the ink 21 on the printing paper 200 along white arrow while converging the same, thereby precisely controlling the range of the ink 21 adhering to the printing paper 200.

The nozzle plate 3 may be supplied with a potential lower than that for the back plate 4.

In order to attain the aforementioned effect, the position of the liquid surface 21*a* is preferably controlled not to reach the second opening 312. This control can be implemented by supplying proper hydrostatic pressure to the ink 21 with a well-known hydrostatic pressure applying mechanism, for example. The nozzle plate 3 may be widely opened on a position closer to the ultrasonic generation means 1 than the first opening 311, and an angle θ (see FIG. 2) of the nozzle plate 3 in the first opening 311 may be increased beyond 270°, for example.

Figure 4:
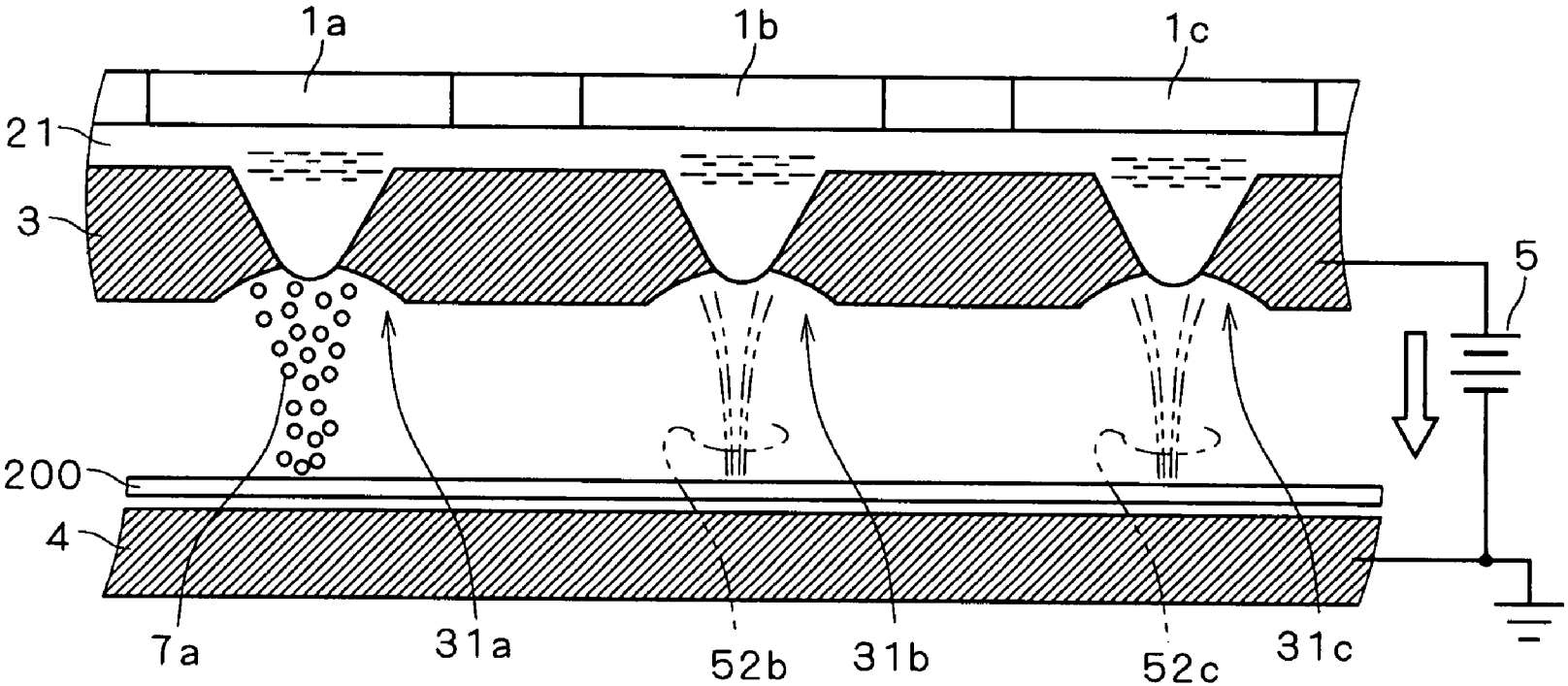
FIG. 4 is a sectional view typically showing a first modification of the embodiment 1 of the present invention.
Figure 5:
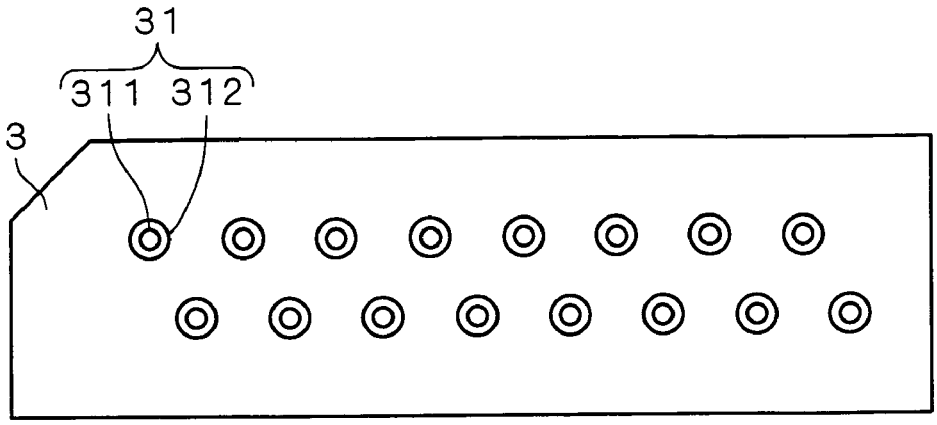
FIG. 5 is a plan view typically showing the first modification of the embodiment 1 of the present invention.

FIG. 4 is a sectional view typically showing a first modification of the embodiment 1 of the present invention. A nozzle plate 3 has a plurality of nozzle holes 31*a*, 31*b* an 31*c* horizontally aligning with each other on the plane of FIG. 4, while ultrasonic generation means 1*a*, 1*b* and 1*c* are provided in opposition to the nozzle holes 31*a*, 31*b* and 31*c* respectively on the opposite side of ink 21 to be drivable independently of each other. Thus, control can be individually performed for spraying the ink 21 from the plurality of nozzle holes 31*a*, 31*b* and 31*c*. FIG. 5 is a typical plan view showing such a nozzle plate 3 having a plurality of nozzle holes 31 as viewed from a side opposed to a printing paper 200. A single nozzle plate 3 can be employed as shown in FIG. 5 also when having a plurality of nozzle holes 31*a*, 31*b* and 31*c* as shown in FIG. 4, so that different potentials can be supplied to the nozzle plate 3 and a single back plate 4.

Referring to FIG. 4, the ultrasonic generation means 1*a* is driven to generate a liquid particle group 7*a*. Electric flux line groups 52*b* and 52*c* show electric flux lines in the vicinity of the nozzle holes 31*b* and 31*c* respectively.

Figure 6:
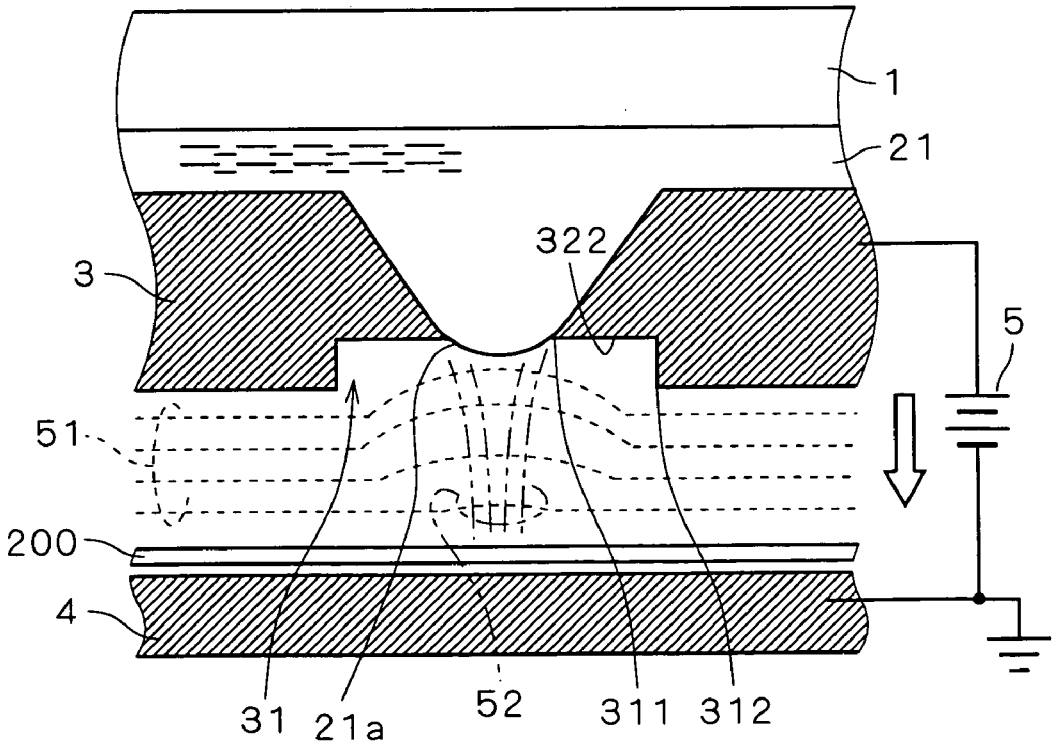
FIG. 6 is a sectional view typically showing a second modification of the embodiment 1 of the present invention.

FIG. 6 is a sectional view showing a second modification of the embodiment 1. A concave portion 322 of a nozzle hole 31 is not curved but has a step dissimilarly to the concave portion 321. However, the concave portion 322 also has a first opening 311 exposing a liquid surface 21*a* and a second opening 312 wider than the first opening 311 and located closer to a printing paper 200 than the first opening 311, whereby an equipotential surface group 51 in the vicinity of the liquid surface 21*a* of ink 21 is convexed with respect to the liquid surface 21*a*. Thus, the ink 21 can be converged and sprayed on the printing paper 200 along white arrow.

Figure 7:
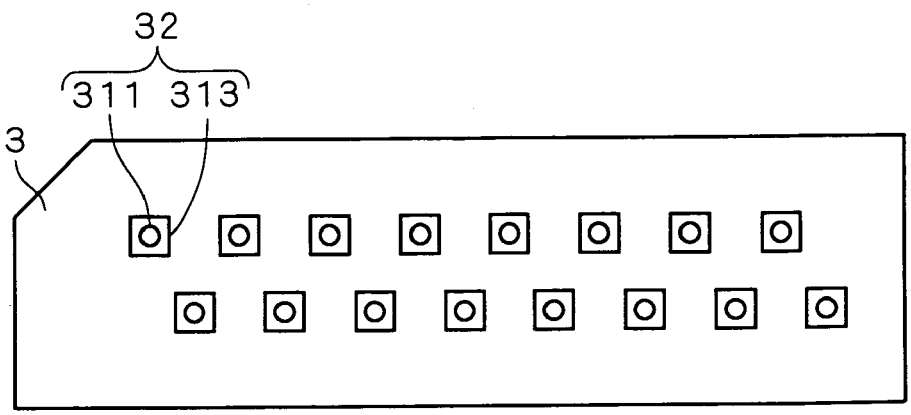
FIG. 7 is a plan view showing a third modification of the embodiment 1 of the present invention.

FIG. 7 is a typical plan view of a third modification of the embodiment 1, showing a nozzle plate 3 having a plurality of nozzle holes 32 as viewed from a side opposed to a printing paper 200. According to this modification, each nozzle hole 32 has a first opening 311 and a second opening 313 wider than the first opening 311 and located closer to the printing paper 200 than the first opening 311. While the first opening 311 is a smooth closed loop, e.g., a circle, the second opening 313 is a rectangle. Also in this case, an equipotential surface group 51 in the vicinity of the liquid surface 21*a* of ink 21 can be convexed with respect to the liquid surface 21*a*.

Embodiment 2

Figure 8:
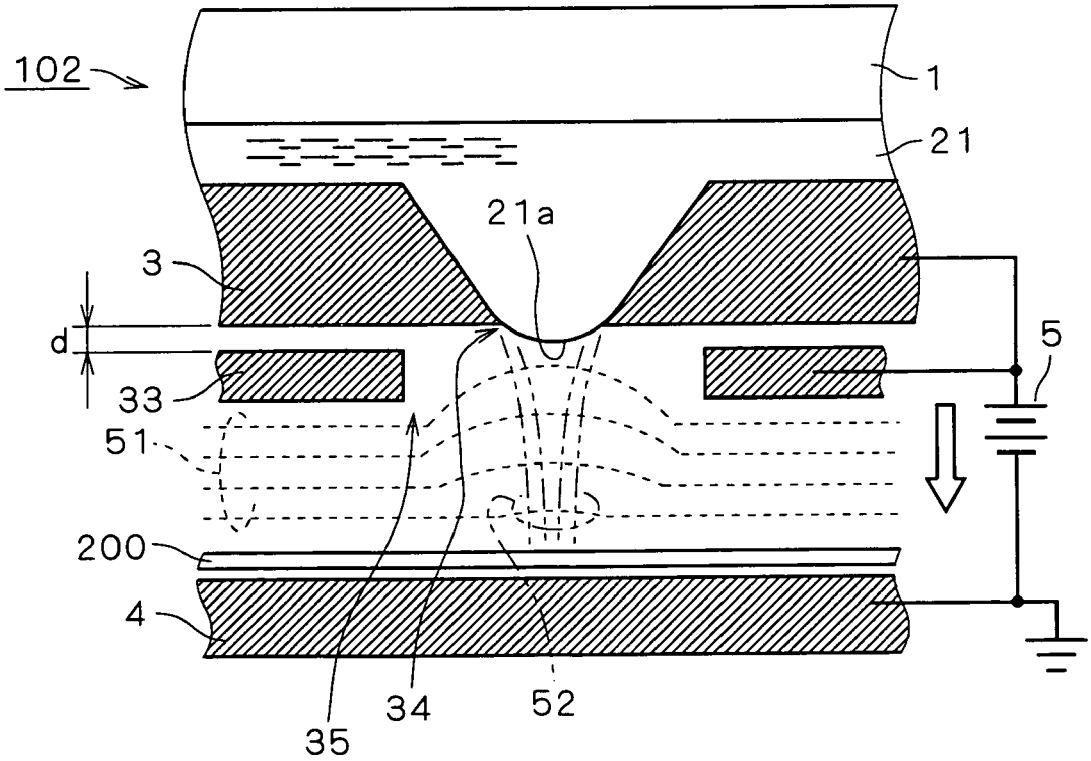
FIG. 8 is a sectional view typically showing the structure of an embodiment 2 of the present invention.

FIG. 8 is a sectional view typically showing the structure of an inkjet head 102 forming a liquid sprayer according to an embodiment 2 of the present invention and the relation between the same and a printing paper 200 forming an object.

The inkjet head 102 comprises ultrasonic generation means 1 and a conductive nozzle plate 3 and stores conductive ink 21 therebetween, similarly to the inkjet head 101. The nozzle plate 3 has a nozzle hole 34 exposing the liquid surface 21*a* of the ink 21.

Dissimilarly to the inkjet head 101, however, the inkjet head 102 comprises a conductive auxiliary plate 33 arranged closer to the printing paper 200 than the nozzle plate 3 and having an opening 35 exposing the nozzle hole 34 toward the printing paper 200. The opening 35 has a function similar to that of the second opening 312 according to the embodiment 1, and the nozzle hole 34 is not formed by openings of two types of diameters dissimilarly to the embodiment 1 but rather serves as the first opening 311.

For example, a dc voltage source 5 supplies the nozzle plate 3 and the auxiliary plate 33 with the same potential different from that for a back plate 4. Also in this case, equipotential surfaces are convexed with respect to the liquid surface 21*a* in the vicinity of the liquid surface 21*a* as shown by an equipotential surface group 51, when properly setting the distance d between the nozzle plate 3 and the auxiliary plate 33 not to be excessive.

According to this embodiment, the auxiliary plate 33 is provided independently of the nozzle plate 3, whereby an electric flux line group 52 converged from the nozzle hole 34 toward the printing paper 200 can be obtained without working the concave portion 321 or 322 on the nozzle plate 3.

Further, the nozzle hole 34 of the nozzle plate 3 has no concave shape such as that around the concave portion 321 or 322, whereby the ink 21 adhering to the nozzle hole 34 can be readily wiped out by moving the auxiliary plate 33.

In addition, this embodiment has no member coupling the nozzle hole 34 with the opening 35 dissimilarly to the case of the concave portion 321 having a smooth shape coupling the first and second openings 311 and 312 with each other, whereby there is a less possibility that the liquid surface 21*a* swells to come into contact with the opening 35. Thus, there is a less possibility that the equipotential surfaces in the vicinity of the liquid surface 21*a* are inhibited from being convexed due to such swelling of the liquid surface 21*a* either.

The nozzle plate 3 and the auxiliary plate 33 may not necessarily be set at the same potential but the auxiliary plate 33 may be set to a positive potential and the nozzle plate 3 may be set to a higher positive potential when the back plate 4 is set to a ground potential, for example. Alternatively, the auxiliary plate 33 may be set to a potential slightly higher than that for the nozzle plate 3. In this case, the equipotential surface group 51 can be slightly concaved with respect to the liquid surface 21*a* of the ink 21 on a position close to the liquid surface 21*a* by about the distance d, while the same is still convexed with respect to the liquid surface 21*a* on a position closer to the printing paper 200. Therefore, the aforementioned effect can be attained when the ink 21 sprayed from the nozzle hole 34 has kinetic energy capable of going over the peak of an electric potential from the nozzle hole 34 toward the opening 35. Such kinetic energy can be attained on the basis of vibrating by ultrasonic generation means 1, for example.

Embodiment 3

Figure 9:
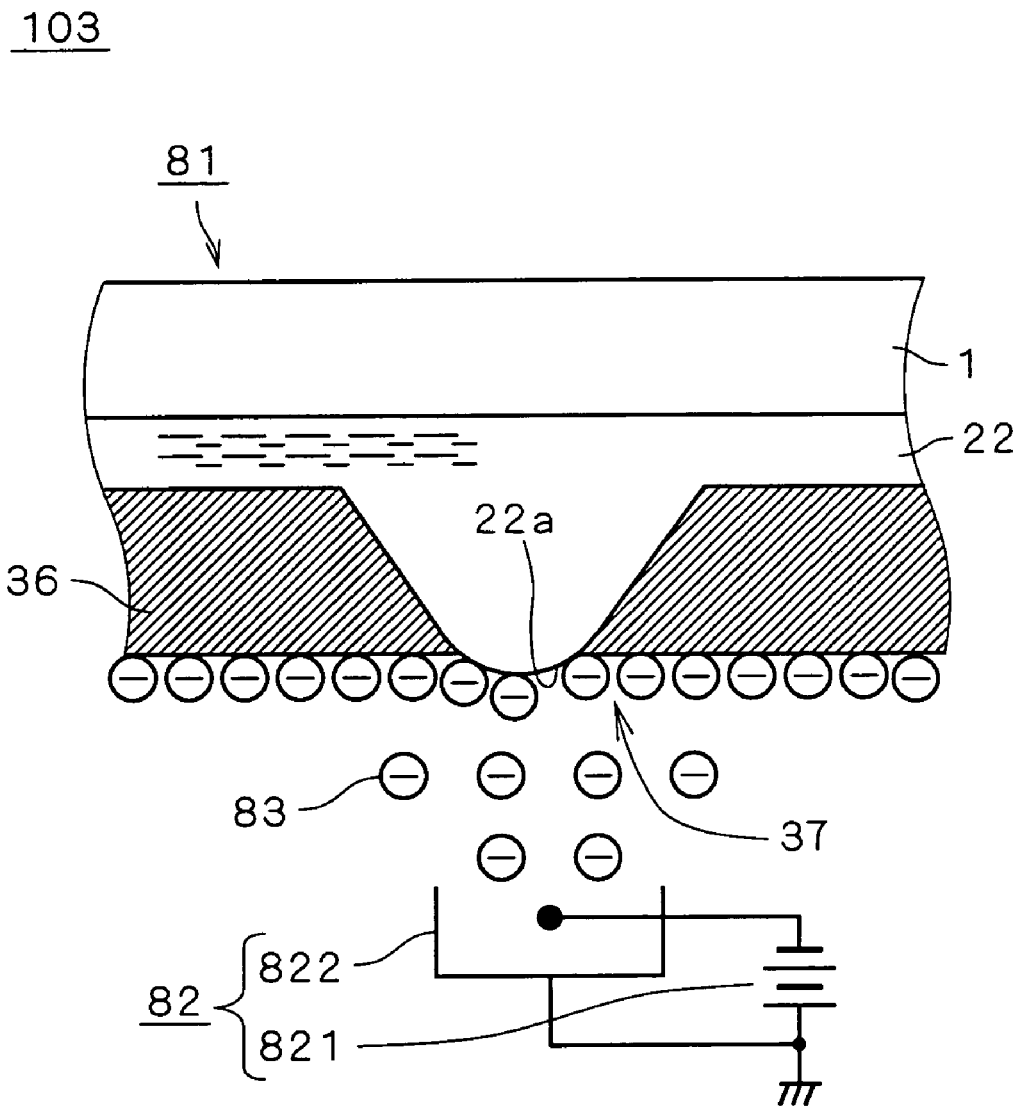
FIGS. 9 and 10 are sectional views typically showing the structure of an embodiment 3 of the present invention.

FIG. 9 is a sectional view typically showing the structure of an inkjet head 103 forming a liquid sprayer according to an embodiment 3 of the present invention. The inkjet head 103 comprises a movable head portion 81 and a corona discharger 82. The movable head portion 81 has ultrasonic generation means 1 and a nozzle plate 36, and stores ink 22 therebetween. The nozzle plate 36 has a nozzle hole 37 exposing the liquid surface 22*a* of the ink 22.

The corona discharger 82 has a dc high voltage source 821 and a pair 822 of discharge electrodes, for example, and ionizes air for generating negative ions 83. In the pair 822 of discharge electrodes, that having a wider area is grounded while a negative potential is applied to a narrower one. The corona discharger 82 is arranged in opposition to the nozzle plate 36, so that the negative ions 83 reach at least the liquid surface 22*a* and the surface of the nozzle plate 36 closer to the liquid surface 22*a* for negatively charging the same.

Figure 10:
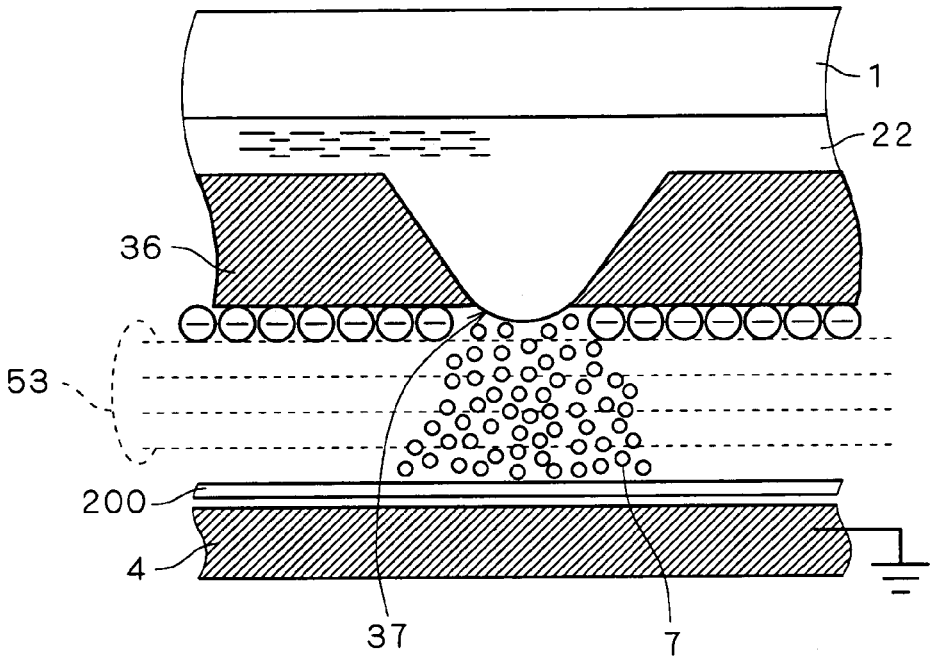

FIG. 10 is a sectional view typically showing the charged movable head portion 81 moving from a position opposed to the corona discharger 82 to a position opposed to the printing paper 200. A back plate 4 is provided on the side of the printing paper 200 opposite to the movable head portion 81 for grounding the same.

Also in this state, a potential gradient is present between the nozzle plate 36 and the printing paper 200, as shown by an equipotential surface group 53. When the ultrasonic generation means 1 is driven to vibrate the ink 22, therefore, an electric field urges and accelerates a generated liquid particle group 7 to move toward the printing paper 200. As compared with the case of simply vibrating the ink 22 with the ultrasonic generation means 1 and spraying the same from the nozzle hole 37, therefore, the ink 22 can properly adhere to the printing paper 200 with a less possibility of floating.

Dissimilarly to the embodiment 1 or 2, the electric field is distributed between the nozzle plate 36 and the back plate 4 not by the dc voltage source 5 but by charging with the corona discharger 82, whereby the potentials of the nozzle plate 36 and the liquid surface 22*a* can be controlled in a non-contact manner. Thus, it is possible to supply the nozzle plate 36 with a potential different from that for the printing paper 200 without connecting a wire.

Due to the charging with the corona charger 82, the nozzle plate 36 and the ink 22 may not necessarily be conductive but may be insulating.

Embodiment 4

Figure 11:
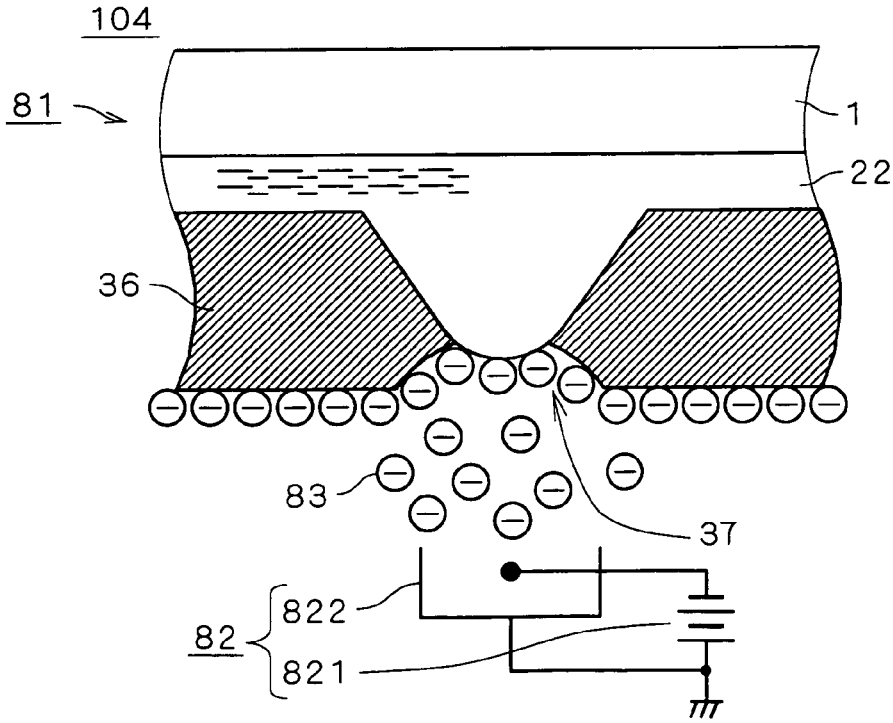
FIGS. 11 and 12 are sectional views typically showing the structure of an embodiment 4 of the present invention.

FIG. 11 is a sectional view typically showing the structure of an inkjet head 104 forming a liquid sprayer according to an embodiment 4 of the present invention. The inkjet head 104 is characteristically different from the inkjet head 103 in a point that a nozzle hole 37 is provided with a concave portion similar to the concave portion 321 of the embodiment 1. Negative ions 83 also charge the nozzle hole 37 similarly to the embodiment 3.

Figure 12:
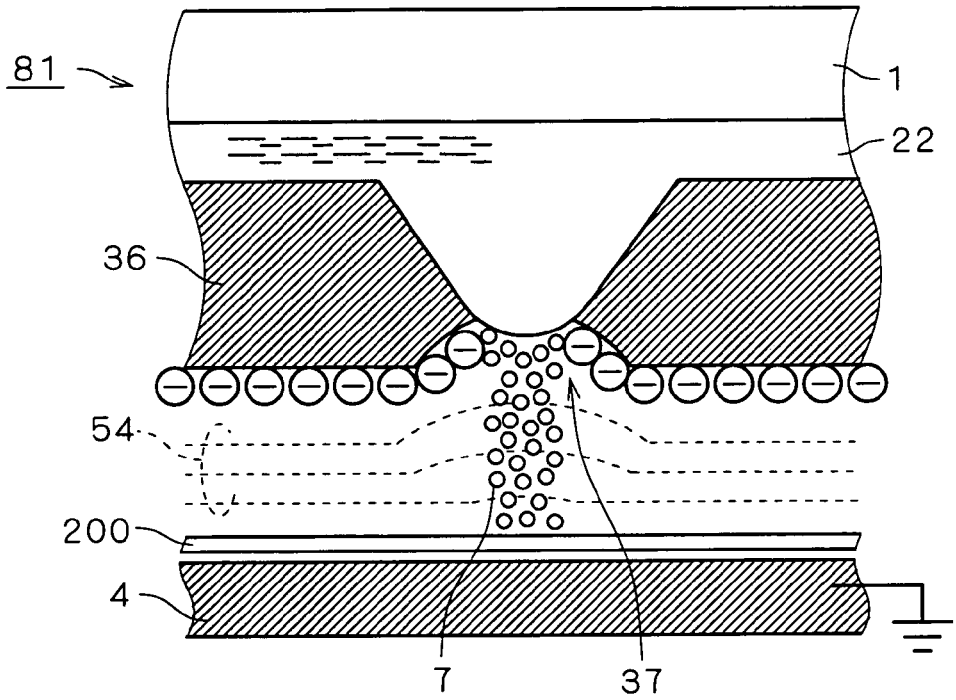

FIG. 12 is a sectional view typically showing a charged movable head portion 81 moving from a position opposed to a corona charger 82 to a position opposed to a printing paper 200. A back plate 4 is provided on a side of the printing paper 200 opposite to the movable head portion 81 for grounding the same.

In this state, an equipotential surface group 54 is convexed with respect to a liquid surface 22*a* in the vicinity of the nozzle hole 37. Therefore, a focusing electric field is formed similarly to the embodiment 1 or 2 so that a liquid particle group 7 is converged and adheres to the printing paper 200. Thus, the range of ink 22 adhering to the printing paper 200 can be precisely controlled similarly to the embodiments 1 and 2 while attaining an effect similar to that of the embodiment 3.

Embodiment 5

Figure 13:
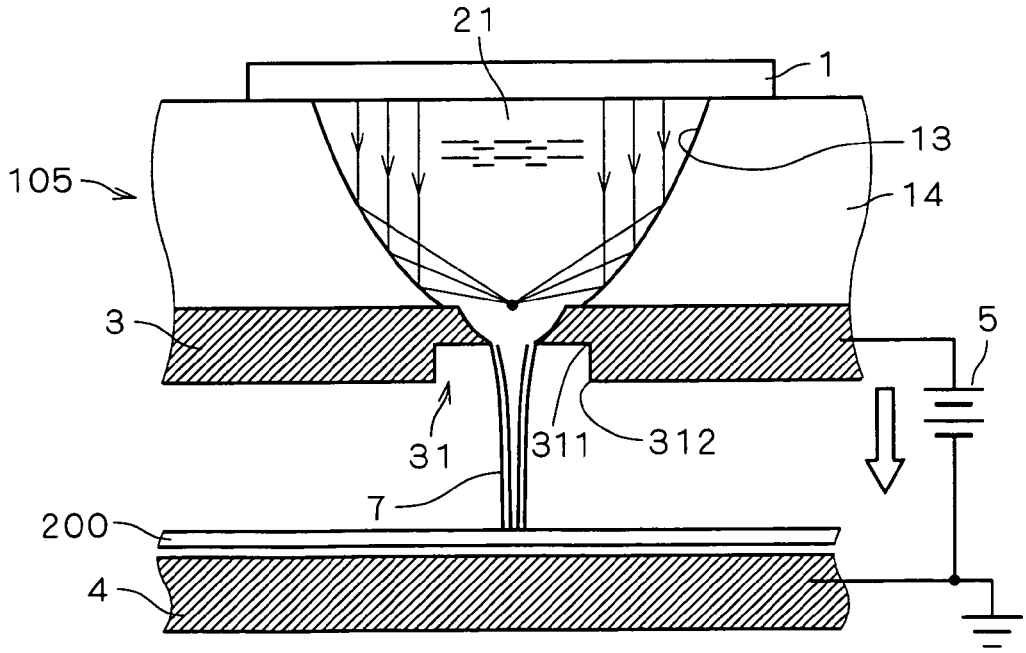
FIG. 13 is a sectional vie typically showing the structure of an embodiment 5 of the present invention.

FIG. 13 is a sectional view typically showing the structure of an inkjet head 105 forming a liquid sprayer according to an embodiment 5 of the present invention. The inkjet head 105 comprises ultrasonic generation means 1, a tank 14 having a reflecting wall 13 and storing ink 21 along with the ultrasonic generation means 1 and a conductive nozzle plate 3 provided on the tank 14 on the opposite side to the ultrasonic generation means 1. The nozzle plate 3 has a nozzle hole 31 similarly to the embodiments 1 and 2, and the nozzle hole 31 has a first opening 311 and a second opening 312. Referring to FIG. 13, a step is defined between the first opening 311 and the second opening 312 similarly to the embodiment 2.

A printing paper 200 is arranged in opposition to the nozzle hole 31, and a back plate 4 is provided on a side opposite to the nozzle hole 31 in relation to the printing paper 200 at least in the vicinity of a position opposed to the nozzle hole 31. Therefore, a focusing electric field can be generated between the nozzle plate 3 and the back plate 4 by supplying potential difference with a dc voltage source 5, similarly to the embodiments 1 and 2.

According to this embodiment, the reflecting wall 13 can converge sound waves generated from the ultrasonic generation means 1 in the vicinity of the nozzle hole 31, whereby sound energy can be increased on the liquid surface of the ink 22 for improving efficiency of spraying a liquid particle group 7. For example, Japanese Patent Application Laid-Open No. 10-278253 (1998) introduces an inkjet head employing such a reflecting wall 13.

Embodiment 6

Figure 14:
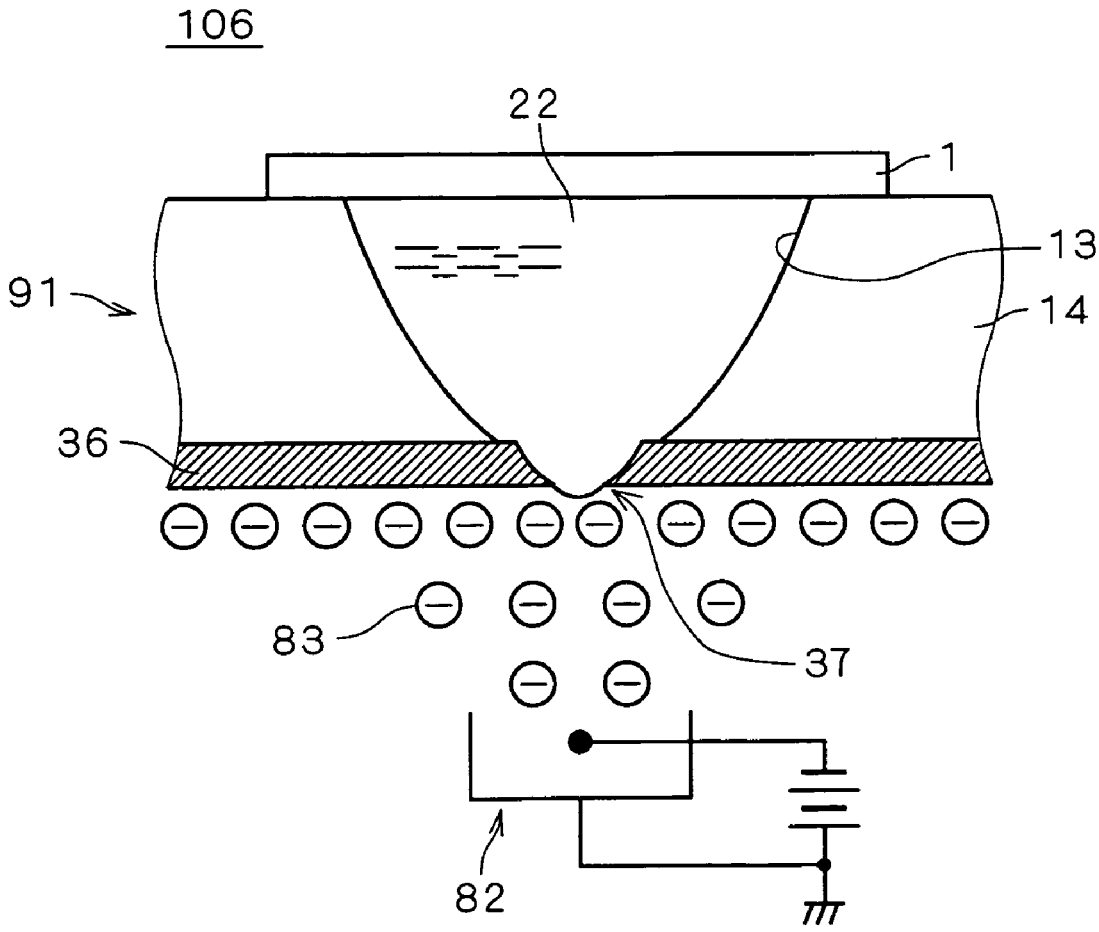
FIG. 14 is a sectional view typically showing the structure of an embodiment 6 of the present invention.

FIG. 14 is a sectional view typically showing the structure of an inkjet head 106 forming a liquid sprayer according to an embodiment 6 of the present invention. The inkjet head 106 comprises a movable head portion 91 and a corona discharger 82. The movable head portion 91 has ultrasonic generation means 1, a tank 14 having a reflecting wall 13 and storing ink 22 along with the ultrasonic generation means 1 and a conductive nozzle plate 36 provided on the tank 14 on the opposite side of the ultrasonic generation means 1. The nozzle plate 36 has a nozzle hole 37 similarly to the embodiments 3 and 4 while presenting no concave portion similarly to the embodiment 3. The corona discharger 82 can be formed similarly to that in the embodiment 3, for example.

Also in this embodiment, effects similar to those of the embodiments 3 and 4 can be attained without requiring conductivity to the ink 22 and the nozzle plate 36. Further, the reflecting wall 13 can converge sound waves generated from the ultrasonic generation means 1 in the vicinity of the nozzle hole 37 similarly to the embodiment 5.

While the invention has been shown and described in detail, the foregoing description is in all aspects illustrative and not restrictive. It is therefore understood that numerous modifications and variations can be devised without departing from the scope of the invention.

What is claimed is:

1. A liquid sprayer comprising:

a liquid holder exposing a liquid surface of conductive liquid sprayed on an object; and a field applier forming an equipotential surface convexed with respect to the liquid surface of a conductive liquid sprayed on an object.

2. The liquid sprayer according to claim 1, wherein said liquid holder comprises a conductive nozzle plate, supplied with a potential different from that for said object, said conductive nozzle plate having:

a first opening exposing said liquid surface, and a second opening wider than said first opening and arranged closer to said object than said first opening.

3. The liquid sprayer according to claim 2, wherein said conductive nozzle plate further comprises:

a concave portion provided between said first opening and said second opening and concaved with respect to said object.

4. The liquid sprayer according to claim 3, wherein the angle in said first opening of said nozzle plate is in excess of 270°.

5. The liquid sprayer according to claim 2, wherein said first and second openings are provided in plural respectively.

6. The liquid sprayer according to claim 5, further comprising:

a vibration exitor provided in correspondence to each of said first openings and vibrating said liquid for spraying said liquid.

7. The liquid sprayer according to claim 2, further comprising:

a step provided between said first opening and said second opening.

8. The liquid sprayer according to claim 7, wherein said first and second openings are provided in plural respectively.

9. The liquid sprayer according to claim 8, wherein the shapes of said first and second openings are not similar to each other.

10. The liquid sprayer according to claim 1, comprising:

a conductive nozzle plate having a first opening exposing said liquid surface, and a conductive auxiliary plate arranged closer to said object than said nozzle plate for exposing said first opening to said object.

11. The liquid sprayer according to claim 10, wherein said nozzle plate and said auxiliary plate are supplied with the same potential.

12. The liquid sprayer according to claim 1, wherein said liquid is supplied with ultrasonic vibration and sprayed from said liquid surface.

13. The liquid sprayer according to claim 12, further comprising:

drive means generating said ultrasonic vibration, and a reflecting wall reflecting said ultrasonic vibration propagating through said liquid and converging said ultrasonic vibration on said liquid surface.

* * * * *